US005412855A

United States Patent [19]

Koch

[11] Patent Number: 5,412,855

[45] Date of Patent: May 9, 1995

[54] CABLE-FEEDING AND CABLE-CHANGING APPARATUS FOR A CABLE PROCESSING MACHINE

[75] Inventor: Max Koch, Meggen, Switzerland

[73] Assignee: Komax Holding AG, Meggen, Switzerland

[21] Appl. No.: 152,208

[22] Filed: Nov. 16, 1993

[30] Foreign Application Priority Data

Nov. 17, 1992 [CH] Switzerland ..... 03525/92

[51] Int. Cl.[6] ..... H01R 43/00

[52] U.S. Cl. ..... 29/33 M; 29/564.2; 29/564.6; 29/755

[58] Field of Search ..... 29/564.4, 564.6, 564.2, 29/755, 566.1, 33 M, 749, 857, 861, 748, 564.1; 140/92.1, 93 R

[56] References Cited

U.S. PATENT DOCUMENTS

| | | | |
|---|---|---|---|
| 3,804,130 | 4/1974 | Tarbox | 140/92.1 |
| 4,030,527 | 6/1977 | Roch | 29/755 X |
| 4,145,807 | 3/1979 | Beetz et al. | 29/564.4 X |
| 4,433,479 | 2/1984 | Suzuki et al. | 29/564.6 X |
| 4,440,053 | 4/1984 | Suzuki et al. | 140/93 R |
| 4,593,452 | 6/1986 | Keahey et al. | 29/564.6 |
| 4,677,734 | 7/1987 | Block et al. | 29/564.2 |
| 4,715,100 | 12/1987 | Cross | 29/33 M |
| 4,879,934 | 11/1989 | Adlon et al. | 83/76.9 |
| 5,052,449 | 10/1991 | Fukuda et al. | 140/93 R |
| 5,146,673 | 9/1992 | Hoffa | 29/564.4 |
| 5,168,611 | 12/1992 | Hornung | 29/33 M |
| 5,188,213 | 2/1993 | Koch | 198/470.1 |
| 5,205,329 | 4/1993 | Suzuki et al. | 140/92.1 |
| 5,235,735 | 8/1993 | Koch | 29/564.4 |

FOREIGN PATENT DOCUMENTS

| | | | |
|---|---|---|---|
| 199653 | 10/1986 | European Pat. Off. | 29/564.4 |
| 0483462 | 5/1992 | European Pat. Off. . | |
| 0496049 | 7/1992 | European Pat. Off. . | |
| 0509192 | 10/1992 | European Pat. Off. . | |
| 2378424 | 8/1978 | France . | |
| 8903601 | 4/1989 | WIPO . | |

OTHER PUBLICATIONS

Prospectus of Komax AG, CH-6036 Dierikon-Lucerne, Switzerland, entitled "Komax 50 M", undated, but coded 5.50/500.1 017206/A.

European Search Report and Annex.

*Primary Examiner*—William Briggs

*Attorney, Agent, or Firm*—Sandler Greenblum & Bernstein

[57] ABSTRACT

A cable-feeding and cable-changing apparatus, whereby a cable change can be performed in an optimized time manner in cable-processing machines which include a stationary pivotable gripper and treatment stations arranged within the pivotal range of a gripper. For this purpose, two cable feeders are provided which are arranged at an acute angle to each other in their cable transport direction and symmetrically to a main transport axis. Displaceable cable-stepping devices are provided between the two sets of belt drives and a v-shaped cable-guiding part is connected by a respective limb to the cable exit side of the cable feeders and the cable-stepping devices, wherein the intersection of the limbs coincides with the main transport axis. During a cable change, and before the retraction of the one cable by the one limb, the other cable is advanced to the intersection by the other limb.

12 Claims, 4 Drawing Sheets

CABLE-FEEDING AND CABLE-CHANGING APPARATUS FOR A CABLE PROCESSING MACHINE

CROSS REFERENCE TO RELATED APPLICATIONS

This application claims the priority of Swiss Application No. 03 525/92-6, filed on Nov. 17, 1992, the disclosure of which is incorporated herein by reference in its entirety.

BACKGROUND OF THE INVENTION

1. Field of the Invention

The invention pertains to a cable-feeding and cable-changing apparatus for a cable-processing machine, which includes at least one stationary pivotable gripper, which in turn holds the cable firmly during the treatment or processing, and in which treatment stations are arranged within the pivotal range of the gripper, wherein at least one cable drive is provided, by means of which the cable is transported and fed to the gripper.

2. Discussion of the Background of the Invention and Material Information

Such cable-feeding and cable-changing equipment, in which cable portions are moved cyclically along a cable-processing line from treatment station to treatment station by means of double-grippers, which firmly hold both ends of such a cable portion, have been disclosed in European Patent Publication EP-A-O 483 462. A band drive, which draws the untreated cable from a roll and transports it in the desired length of the cable portions, is arranged at the beginning of the cable processing line. As further disclosed in prospectus 50M of the firm of Komax AG, CH-6036 Dierikon - Lucerne, Switzerland, a cable-stepping device can be arranged before the band drive, which enables an automatic cable change of different cables, with different cross-sections and colors, without the treatment of the cable portions having to be interrupted at the individual treatment stations.

In a cable-processing machine of the type disclosed in prior art European Patent Publication EP-A-O 509 192, the cable is fed, by means of a band drive, to a stationary pivotable gripper, whereupon the cable end, held by the gripper, is pivoted sequentially for the purpose of treatment towards the treatment stations arranged within the pivotal range. Thereafter, the cable end is cut to the required length, transferred to a second pivotable gripper and treated further until finished. Cable-processing machines of that type are less expensive and smaller than those described in the preceding paragraph and enable the processing of very short (about 60 millimeters) to very long (5 to 10 meters) leads. During a cable change due to another cross-section or another color, considerable production time however is lost in such machines, since the old cable, still being held by the first gripper, must be retracted and the new cable must thereafter be fed to the band drive.

SUMMARY OF THE INVENTION

This invention has the task or object, starting at the previously-described state of the art, to develop cable-feeding and cable-changing equipment for cable-processing machines, in which less production time is lost due to cable changes.

This purpose is accomplished by the invention via a cable-feeding and cable-changing apparatus for a cable-processing machine for processing a plurality of cables, wherein the apparatus includes at least one stationary pivotable gripper for firmly holding a first cable during this processing; at least one processing station arranged within the pivotal range of the gripper; at least one cable feeder for transporting and feeding the cable to the gripper; at least one further feeder drive, wherein the cable feeders are arranged to extend at an acute angle to each other in their cable transport direction and symmetrically to a main transport axis; and a cable-stepping device for each cable drive. In one embodiment of this invention, a v-shaped cable-guiding part, this v-shaped cable-guiding part being connected by a respective limb to a cable exit side of the cable feeders wherein an intersection of both of the limbs coincides with the transport axis; and wherein, during a cable change and before a retraction of the first cable by one of the respective limbs, a second cable is advanced to the intersection by the other of the respective limbs.

In another embodiment of this invention, the cable feeders comprise two belt drives, with the cable-stepping devices being displaceably arranged between the belt drives. The respective limbs of the v-shaped cable-guiding part comprise tubes which are connected together, at the intersection, by a junction.

Further details of the cable-feeding and cable-changing apparatus of this invention include a centering part, arranged so as to be displaceable at the gripper; the centering part including at least one centering tube, the internal diameters thereof being different and corresponding with the diameters of the cables to be processed; an abutment device displaceable into the pivotal range of the gripper with the centering part being displaceable against the said abutment device during a pivotal movement of the gripper.

The cable-feeding and cable-changing apparatus of this invention further includes that the cable-stepping devices are comprised of a cable-feeding strip, a cable-guiding strip and a cable exit strip, and an upper and a lower crossbeam for connecting these strips, with the cable-guiding strips further including cable passages; cable-guiding inserts having horizontally extending passages coaxial with the cable passages of the cable-guiding strip, with the cable-guiding inserts being replaceably mounted at the cable-feeding strip and the cable exit strip, with cable passages being provided for the reception of cables of different cross-sections and colors; and clamps for firmly clamping the cables at the cable-guiding inserts.

Preferably, two cable feeders are provided, which are arranged to extend, at an acute angle to each other in their cable transport direction, and symmetrically to a main transport axis. For the purpose of a cable change, displaceable cable-stepping devices are associated with the cable feeders. A V-shaped cable-guiding part is connected by a respective limb to the cable exit side of the cable feeders and the cable-stepping devices, wherein the intersection of both limbs lies on the main transport axis. During a cable change and before the retraction of the old cable by the one limb, the new cable is advanced to the intersection by the other limb.

The advantages achieved by the present invention are realized in that a cable change is performable in an optimum time span or frame even with the less expensive and smaller cable-processing machines of the previously described type. The equipment or apparatus required for this operation is built in a simple manner at favorable costs, since merely one additional cable drive, two cable-stepping devices and the V-shaped cable-guiding part are required.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
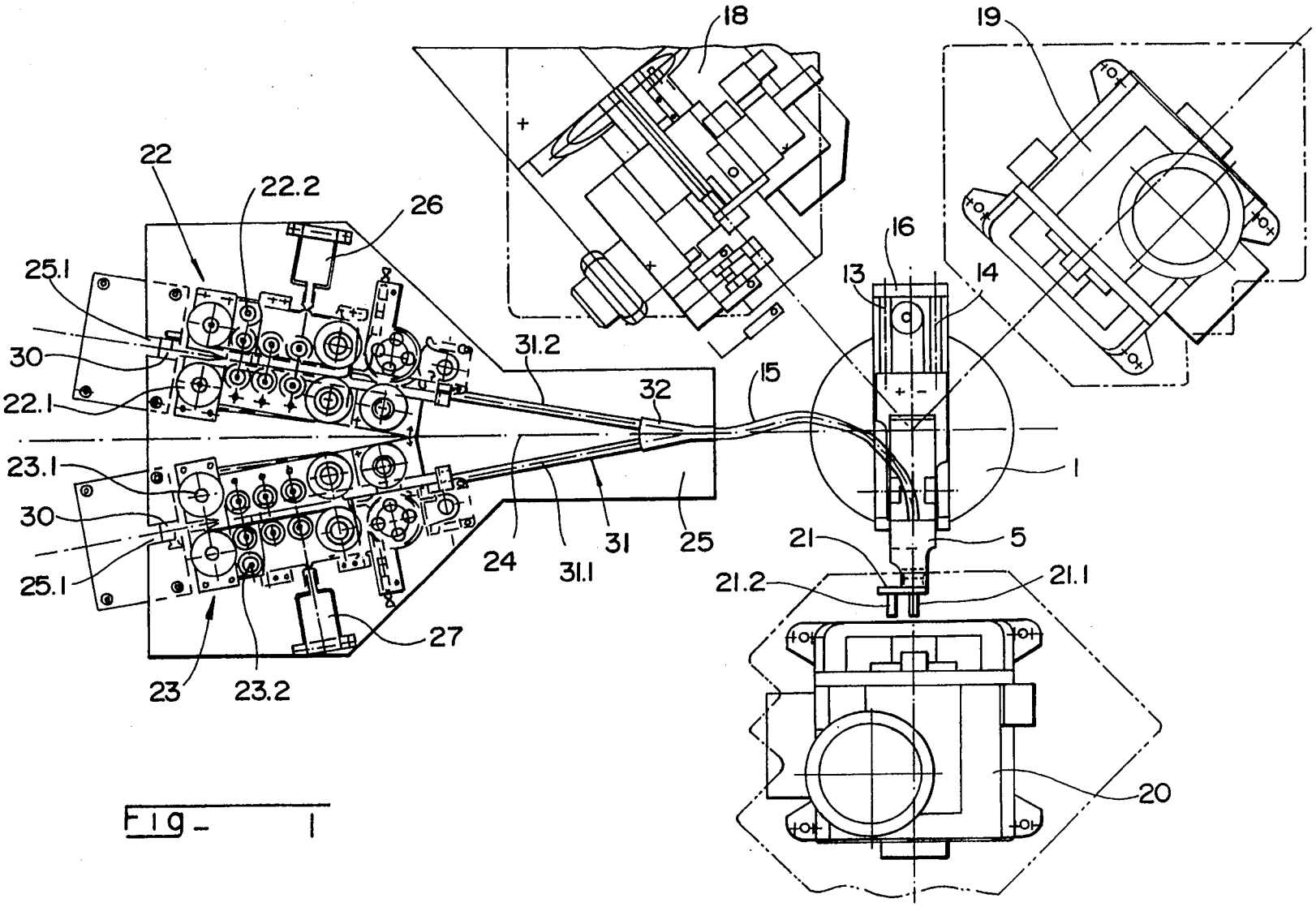
FIG. 1 is a plan view of the essential parts of a cable-processing machine with the equipment according to the invention.
Figure 2:
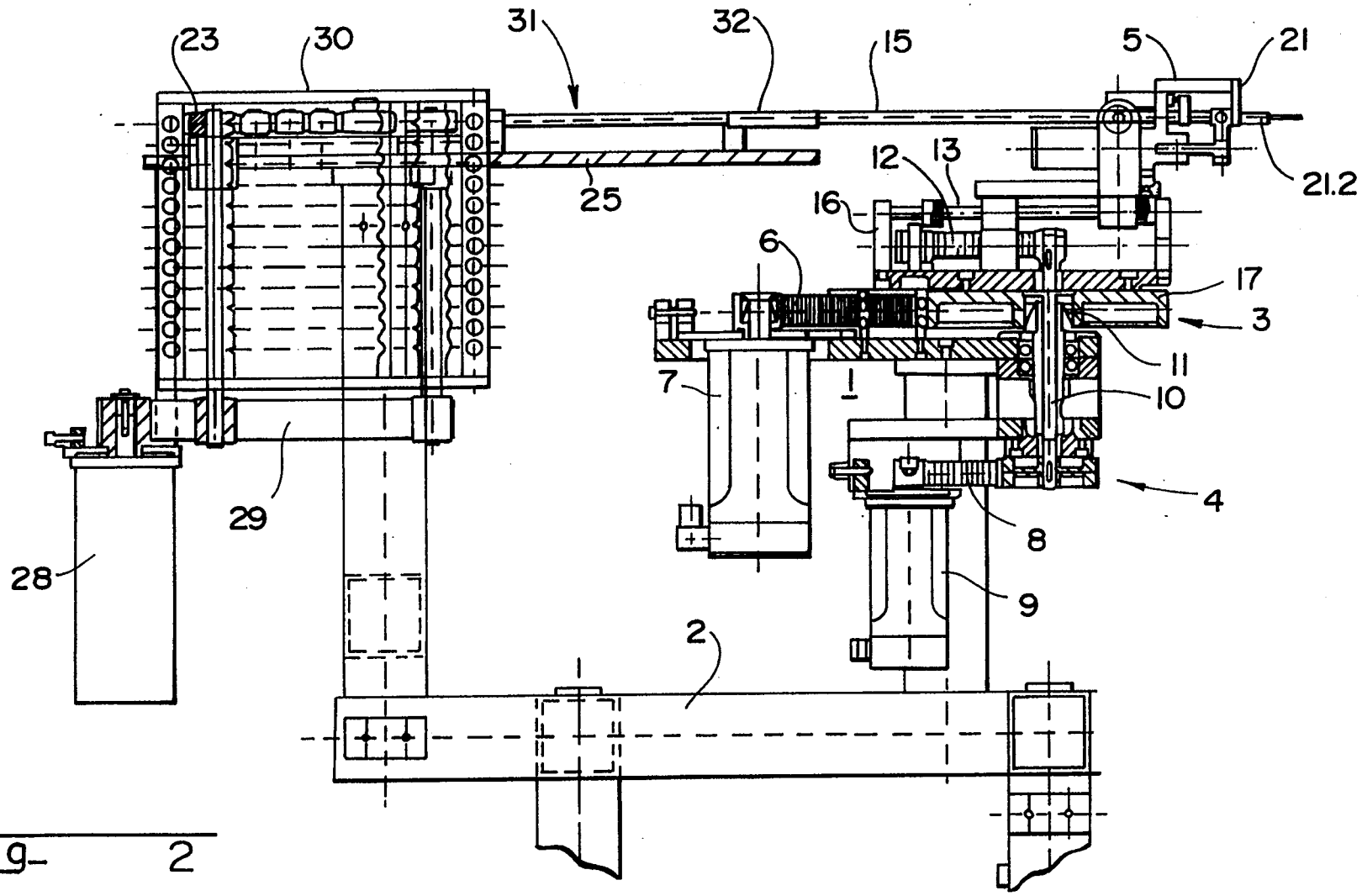
FIG. 2 is a partially sectioned view of the cable-processing machine with the equipment according to the invention, with a gripper pivoted through 90° in comparison with FIG. 1.

With reference to FIGS. 1 and 2 a subassembly 1 is arranged at a machine frame 2 which, in similar form, is also disclosed in the previously noted European Patent Publication EP-A-O 509 192. Subassembly 1 includes a pivotal drive 3, a take-off drive 4 and a clamping device in the form of a gripper 5. Pivotal drive 3 includes a toothed belt drive 6 and motor 7. Take-off drive 4 includes a toothed drive 8 as well as a motor 9, wherein an output shaft 10 of toothed belt drive 8 extends co-axially in a hollow output shaft 11 of toothed belt drive 6. Gripper 5 can be displaced by means of a further toothed belt drive 12, driven from toothed belt drive 8, and is, for this purpose, arranged on guide rods 13 and 14. Gripper 5 serves for the retention of a cable 15 that is to be processed and can, for example, be actuated pneumatically. Guide rods 13 and 14 are carried at a bearing part 16, which in turn is fastened on an output wheel 17 of toothed belt drive 6. Upon the actuation of pivotal drive 3, gripper 5, together with cable 15, is pivoted about the center of rotation of output wheel 17. Treatment stations 18, 19 and 20, which, for example, serve for the addition of sockets or grommets, the pressing-on of electrical terminal elements and the testing for manufacturing faults of the cable portions being fabricated, are arranged within the pivotal range of gripper 5.

A centering part 21, which includes at least two centering tubes 21.1 and 21.2, the internal diameters of which are different and correspond with the diameters of the cables to be treated, is displaceably arranged at gripper 5. Centering part 21 can be displaced by means of an abutment (item A in FIG. 5*c*), which may, for example, be actuated pneumatically or electromagnetically.

Figure 3:
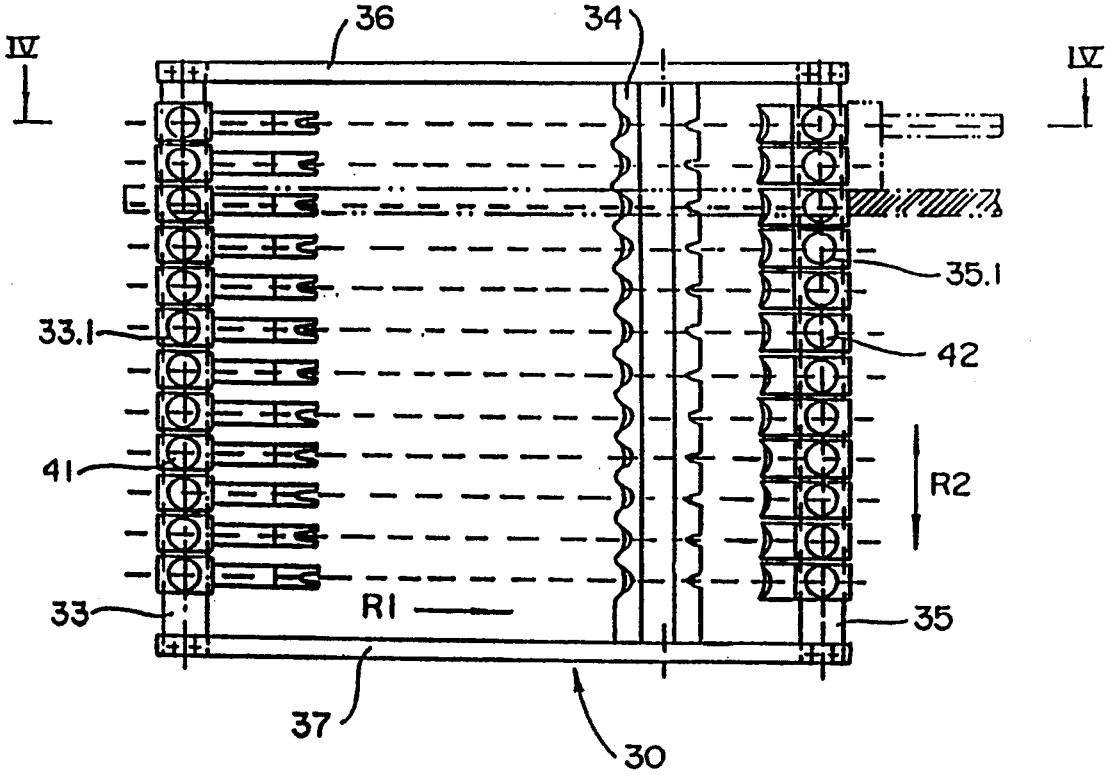
FIG. 3 is a cable-stepping device of the equipment according to FIG. 1.
Figure 4:
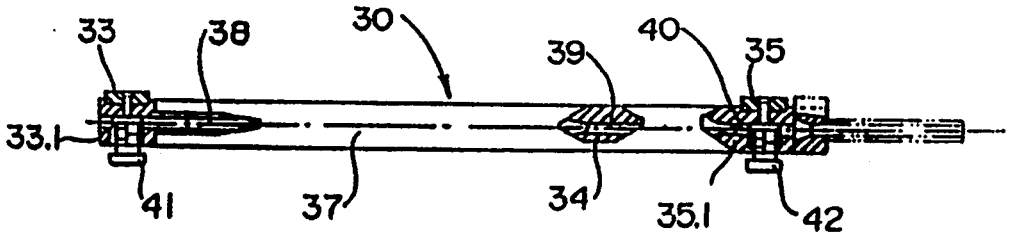
FIG. 4 is a section of the cable-stepping device along line IV—IV in FIG. 3.

Cable feeders in the form of belt drives, by means of which untreated cables can be fed to the gripper 5, are denoted by elements 22 and 23. Cable feeders of that type are, for example, disclosed in prior art European Patent Publication EP-A-O 496 049. Feeders 22 and 23 are arranged to extend at an acute angle to each other in their cable transport direction and symmetrically to a main transport axis 24 and are fastened on a mounting plate 25 connected with the machine frame 2. As is known from previously noted EP-A-O 496 049, each feeder includes a stationary belt drive 22.1 and 23.1 as well as movable belt drive 22.2 and 23.2, wherein the movable belt drives can be displaced by piston-cylinder units 26 and 27. The belt drives are driven by a motor 28 via a toothed belt drive 29. Cable-stepping devices 30, which will be described in more detail hereinafter, with reference to the FIGS. 3 and 4, are arranged between belt drives 22.1 and 22.2 as well as belt drives 23.1 and 23.2. Cable-stepping devices 30 can be displaced perpendicularly to the cable transport direction of the feeders 22 and 23 by means of non-illustrated and non-described drives, for which a slot-shaped cut-out 25.1 is provided in mounting plate 25. A V-shaped cable-guiding part 31 is connected by a respective limb 31.1 and 31.2 to the cable exit side of the feeders 22 and 23 and the cable-stepping devices 30, wherein the intersection of both limbs coincides with transport axis 24. Limbs 31.1 and 31.2 consist of tubes which are connected together in the intersection by means of a socket or coupler 32. Cable-guiding part 31 is fastened to mounting plate 25 by coupler 32 and the ends of tubes 31.1 and 31.2.

As shown in FIGS. 3 and 4, cable-stepping device 30 consists of a cable-feeding strip 33, a cable-guiding strip 34 and a cable exit strip 35, all of which are connected together by means of an upper and a lower crossbeam 36 and 37. Cable-guiding inserts 33.1 and 35.1 which include horizontally extending cable passages 38 and 40, and are coaxial with cable passages 39 of the cable-guiding strip 34, are mounted, so as to be replaceable, at strips 33 and 35. Cable passages 38, 39 and 40 are provided for the reception of cables of different cross-sections and colors, wherein for example, twelve cable-guiding inserts are respectively provided for twelve different cables. Clamps 41 and 42, by means of which the cables can be firmly clamped, are provided at the cable-guiding inserts 33.1 and 35.1. For the purpose of adaptation to belt drives 22.1 and 22.2 or 23.1 and 23.2 and rollers of feeders 22 and 23, cable-guiding inserts 33.1 and 35.1 and the cable-guiding strip 34 are bevelled in cross-section at the appropriate places (see also FIG. 2). In FIG. 3 the cable transport direction is denoted by R1 and the direction of displacement of the cable-stepping device 30 is denoted by R2, for which the cable-stepping device 30 is, for example, disposed in a setting in which the first one of a series of cables is fed to the cable-guiding part 31 (chain-dotted lines).

Figure 5A:
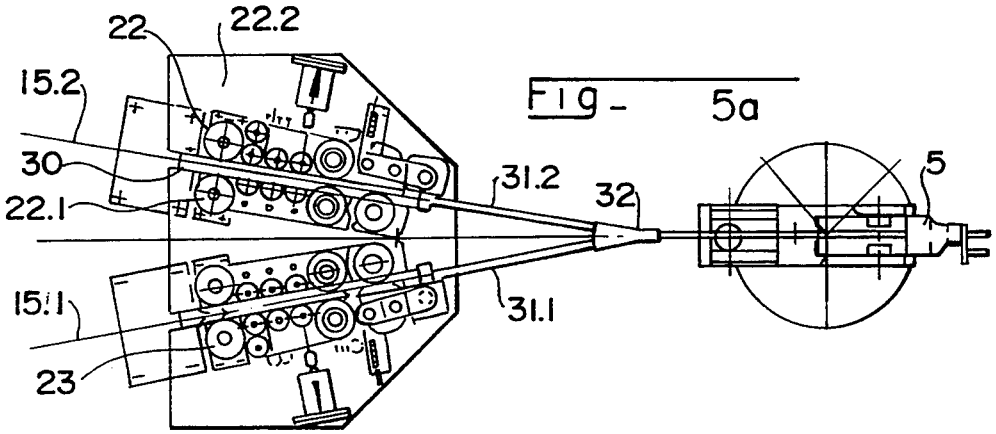
FIGS. 5*a*–5*d* are sequential illustrations of a cable-changing operation.
Figure 5B:
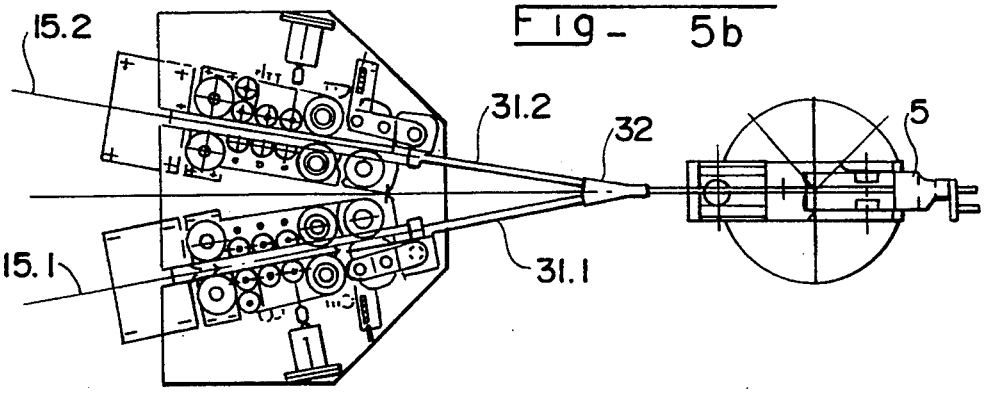
Figure 5C:
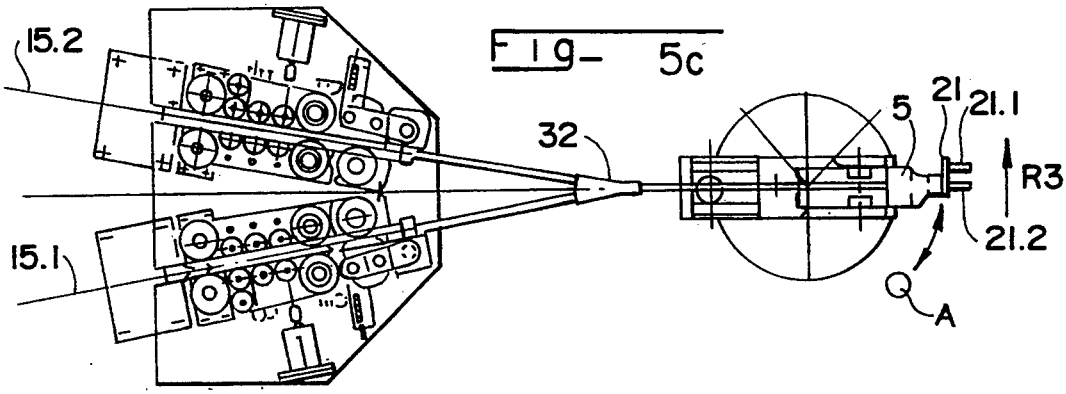
Figure 5D:
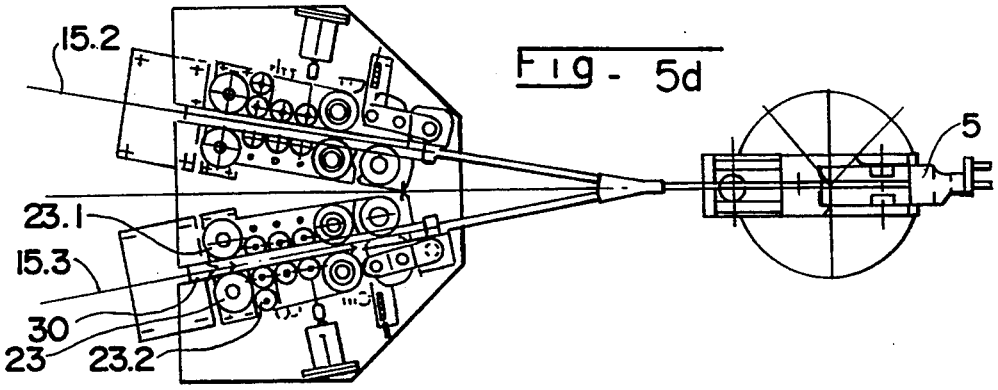

The previously described equipment or apparatus operates in the following manner:

It is assumed that cable feeder 23 transports a cable 15.1, of a certain cross-section and a certain color through a length corresponding to the length of a cable portion to be fabricated, via limb 31.1 of cable-guiding part 31 to gripper 5 (FIG. 5*a*). At the same time, cable-stepping device 30 of cable feeder 22 pushes a cable 15.2 of different cross-section and/or different color between opened belt drives 22.1 and 22.2 of band drive 22, whereafter belt drives 22.1 and 22.2 are closed, clamps 41 and 42 of the cable-stepping device 30 are opened and cable 15.2 is transported by limb 31.2 to coupling 32 (FIGS. 5*a* and 5*b*). For the purpose of the treatment of cable 15.1, the end thereof held by the gripper 5 is pivoted, by means of the pivotal drive 3, to treatment stations 18, 19 and 20 (FIG. 1). After treatment, the cable end of cable 15.1 is transferred to a further, non-illustrated gripper and cut off to the required or set length. Thereafter, cable 15.1 is transported back to the coupling 32 (FIG. 5*c*). It is now further assumed that the cable 15.2, which is to be treated in succession, displays a different cross-section. In this case, abutment A (FIG. 5*c*) is pushed briefly into the pivotal range of gripper 5 and centering part 21 is displaced in the direction of arrow R3 via abutment against abutment A during a pivotal movement of gripper 5 so that the corresponding centering tube 21.2 comes into use (FIG. 5*c*). Thereafter, cable 15.2 is transported to gripper 5 and, for example, treated in like manner as cable 15.1 (FIG. 5*d*). In the meantime, cable 15.1 is transported back into cable-stepping device 30 and clamped firmly by means of clamps 41 and 42. After the opening of belt drives 23.1 and 23.2, cable-stepping device 30 can be displaced and thereby bring a further cable 15.3, which is, for example, different from cables 15.1 and 15.2, into cable feeder 23 (FIG. 5*d*).

While there are shown and described present preferred embodiments of the invention, it is to be distinctly understood that the invention is not limited thereto, but may be otherwise variously embodied and practiced within the scope of the following claims and the reasonably equivalent structures thereto.

What is claimed is:

1. A cable-feeding and cable-changing apparatus for a cable-processing machine for processing a plurality of cables, said apparatus comprising in combination:

at least one stationary pivotable gripper for firmly holding a first cable during said processing;

at least one processing station arranged within the pivotal range of said gripper;

at least one cable feeder for transporting and feeding said cable to said gripper;

at least one further cable feeder, wherein said cable feeders are arranged to extend at an acute angle to each other in their cable transport direction and symmetrically to a main transport axis; and a cable-stepping device for at least one of said cable feeders.

2. The cable-feeding and cable-changing apparatus of claim 1, further comprising a v-shaped cable-guiding part, said v-shaped cable-guiding part being connected by a respective limb to a cable exit side of said cable feeders, wherein an intersection of both of said limbs coincides with said transport axis; and wherein, during a cable change and before a retraction of said first cable by one of said respective limbs, a second cable is advanced to said intersection by the other of said respective limbs.

3. The cable-feeding and cable-changing apparatus of claim 2, wherein each cable feeder comprises two belt drives, with said cable-stepping devices being displaceably arranged between said belt drives.

4. The cable-feeding and cable-changing apparatus of claim 2, wherein the respective limbs of said v-shaped cable-guiding part comprise tubes which are connected together, at said intersection, by a junction.

5. The cable-feeding and cable-changing apparatus of claim 2, further comprising:

a centering part, said centering part being arranged so as to be displaceable at said gripper;

said centering part including at least one centering tube, the internal diameter of said centering tube being different and corresponding with the diameters of said cables to be processed;

an abutment device, said abutment device being displaceable into the pivotal range of said gripper; and said centering part being displaceable against said abutment device during a pivotal movement of said gripper.

6. The cable-feeding and cable-changing apparatus of claim 2, further including:

said cable-stepping devices being comprised of a cable-feeding strip, a cable-guiding strip and a cable exit strip, and an upper and a lower crossbeam for connecting said strips, said cable-guiding strips further including cable passages;

cable-guiding inserts, said cable-guiding inserts including horizontally extending passages coaxial with the cable passages of said cable-guiding strip, said cable-guiding inserts being replaceably mounted at said cable-feeding strip and said cable exit strip;

said cable passages being provided for the reception of cables of different cross-sections and colors; and clamps for firmly clamping said cables at said cable-guiding inserts.

7. In a cable-feeding and cable-changing apparatus for a cable-processing machine for processing a plurality of cables, wherein the apparatus includes at least one stationary pivotable gripper for firmly holding a first cable during said processing; at least one processing station arranged within the pivotal range of said gripper; and at least one cable feeder for transporting and feeding said cable to said gripper; the improvement comprising:

at least one further cable feeder, wherein said cable feeders are arranged to extend at an acute angle to each other in their cable transport direction and symmetrically to a main transport axis;

a cable-stepping device for each cable feeder;

a v-shaped cable-guiding part, said v-shaped cable-guiding part being connected by a respective limb to a cable exit side of said cable feeders, wherein an intersection of both of said limbs coincides with said transport axis; and wherein, during a cable change and before a retraction of said first cable by one of said respective limbs, a second cable is advanced to said intersection by the other of said respective limbs.

8. The cable-feeding and cable-changing apparatus of claim 7, wherein each cable feeder comprises two belt drives, with said cable-stepping devices being displaceably arranged between said belt drives.

9. The cable-feeding and cable-changing apparatus of claim 7, wherein the respective limbs of said v-shaped cable-guiding part comprise tubes which are connected together, at said intersection, by a socket joint.

10. The cable-feeding and cable-changing apparatus of claim 7, further comprising:

a centering part, said centering part being arranged so as to be displaceable at said gripper;

said centering part including at least two centering tubes, the internal diameters of said centering tubes being different and substantially corresponding with the diameters of said cables being processed;

an abutment, said abutment being displaceable into the pivotal range of said gripper; and said centering part being displaced against said abutment during a pivotal movement of said gripper.

11. The cable-feeding and cable-changing apparatus of claim 7, wherein said cable-stepping devices are comprised of a cable-feeding strip, a cable-guiding strip and a cable exit strip, and an upper and a lower crossbeam for connecting said strips, said cable-guiding strips further including cable passages.

12. The cable-feeding and cable-changing apparatus of claim 11, further including:

cable-guiding inserts, said cable-guiding inserts including horizontally extending passages coaxial with the cable passages of said cable-guiding strip, said cable-guiding inserts being replaceably mounted at said cable-feeding strip and said cable exit strip;

said cable passages being provided for the reception of cables of different cross-sections and colors; and clamps for firmly clamping said cables at said cable-guiding inserts.

* * * * *